US007686588B2

(12) United States Patent
Okumura et al.

(10) Patent No.: US 7,686,588 B2
(45) Date of Patent: Mar. 30, 2010

(54) LIQUID CHEMICAL SUPPLY SYSTEM HAVING A PLURALITY OF PRESSURE DETECTORS

(75) Inventors: Katsuya Okumura, Tokyo (JP); Tetsuya Toyoda, Komaki (JP); Tomohiro Ito, Komaki (JP); Akira Murakumo, Komaki (JP); Atsuyuki Sakai, Komaki (JP)

(73) Assignees: OCTEC Inc., Tokyo (JP); CKD Corporation, Aichi (JP)

( * ) Notice: Subject to any disclaimer, the term of this patent is extended or adjusted under 35 U.S.C. 154(b) by 232 days.

(21) Appl. No.: 11/581,464

(22) Filed: Oct. 17, 2006

(65) Prior Publication Data

US 2007/0122291 A1 May 31, 2007

(30) Foreign Application Priority Data

Oct. 17, 2005 (JP) ..... 2005-301439

(51) Int. Cl.
*F04B 49/22* (2006.01)

(52) U.S. Cl. ..... 417/21; 417/26; 417/46; 417/384

(58) Field of Classification Search ..... 417/46; 73/1.72

See application file for complete search history.

(56) References Cited

U.S. PATENT DOCUMENTS 4,469,055 A * 9/1984 Caswell ..... 123/78 B
5,024,100 A * 6/1991 Weinstein ..... 73/756
5,421,208 A * 6/1995 Packard et al. ..... 73/861
5,641,270 A * 6/1997 Sgourakes et al. ..... 417/44.2
5,772,412 A * 6/1998 Zytynski ..... 417/393
6,047,244 A * 4/2000 Rud, Jr. ..... 702/98
6,183,223 B1 2/2001 Yajima

FOREIGN PATENT DOCUMENTS

JP A 4-215420 8/1992
JP A 10-061558 3/1998
JP A 11-343978 12/1999

* cited by examiner

*Primary Examiner*—Devon C Kramer
*Assistant Examiner*—Philip Stimpert
(74) *Attorney, Agent, or Firm*—Oliff & Berridge, PLC

(57) ABSTRACT

A liquid chemical supply system that performs accurate pressure feedback control and controls the discharge flow rate of liquid chemical with high precision, even when the pressure setting value of the operation pressure differs due to changes in the type of liquid chemical, includes a pump having a pump chamber and an operation chamber separated by a diaphragm comprised of a flexible membrane. The intake and discharge of liquid chemical is performed in accordance with the change in pressure inside the operation chamber. An electro-pneumatic regulator supplies operation gas pressure to the operation chamber. A plurality of pressure sensors having different pressure detection ranges is provided for detecting the operation gas pressure. A controller selectively employs any of the detection results of the plurality of sensors in accordance with the pressure setting value of the operation air that is set for each use, and performs pressure feedback control.

17 Claims, 6 Drawing Sheets

LIQUID CHEMICAL SUPPLY SYSTEM HAVING A PLURALITY OF PRESSURE DETECTORS

The present application claims priority based on Japan Patent Application No. 2005-301439, filed on Oct. 17, 2005, and the entire contents of that application are incorporated by reference in this specification.

FIELD OF THE INVENTION

The present invention relates to a liquid chemical supply system that, among other things, serves to intake a liquid chemical by means of a liquid chemical pump, and then discharge a fixed quantity thereof, and also relates to a liquid chemical supply system that is ideal for use in a liquid chemical usage process of a semiconductor manufacturing device, such as a liquid chemical application process.

BACKGROUND ART

A liquid chemical pump is employed in a liquid chemical usage process of a semiconductor manufacturing device in order to apply a predetermined quantity of liquid chemical to a semiconductor wafer. One liquid chemical pump that is known has a pump chamber filled with liquid chemical, and an operation chamber that introduces operating air, which are separated by a flexible membrane such as a diaphragm, and the flexible membrane is deformed by adjustably setting the air pressure inside the operation chamber in order to draw in and discharge the liquid chemical (see, for example, Japan Published Patent Application No. H11-343978).

In a liquid chemical supply system in which the liquid chemical pump described above is employed, the control precision of the liquid chemical discharge flow rate is improved by controlling the air pressure inside the operation chamber with high precision. More specifically, the air pressure is detected by a pressure sensor, and feedback control is performed so as to match the detected pressure with a target pressure setting value.

In addition, the liquid chemicals supplied by the liquid chemical supply system have various fluid viscosities, and it is thought that the control precision of the discharge flow rate is influenced by the different fluid viscosities of the liquid chemicals. When the control precision of the discharge flow rate changes in response to the type, etc. of liquid chemical, the quality of the product, such as the semiconductor wafer, may be influenced thereby.

SUMMARY OF THE INVENTION

An object of the present invention is primarily to provide a liquid chemical supply system that can always perform suitable pressure feedback control even when the pressure setting value of the operation pressure differs due to a change in the type of liquid chemical, etc., thereby controlling the discharge flow rate of a liquid chemical with high precision.

In a liquid chemical supply system that is one aspect of the present teachings, operation gas can be supplied from an operation gas supply device to the operation chamber of a liquid chemical pump, and when this occurs, the intake and discharge of liquid chemical may be performed by changing the volume of the pump chamber in accordance with the change in the pressure inside the operation chamber. In addition, a plurality of pressure detectors having different pressure detection ranges can be provided as pressure detection means for detecting the pressure of the operation gas supplied by the operation gas supply device. Then, pressure feedback control may be performed by selectively employing one of the detection results of the plurality of pressure detectors in accordance with the pressure setting value of the operation gas that is set for each use.

The setting value of the operation gas pressure in the liquid chemical pump is changed in accordance with the type of liquid chemical to be used each time and other conditions, and there will be times in which the pressure setting value is high, and other times in which the pressure setting value is low. Here, when the same pressure detector is used in all of these situations in order to perform pressure feedback control, the control precision may differ in the situations. In other words, there is a predetermined relationship for each liquid chemical between the discharge flow rate of the liquid chemical and the operation gas pressure, e.g., if the discharge flow rate of the liquid chemical is to be kept constant, then the control range of the operation gas pressure when the pressure setting value is low will be narrower than that of the operation gas pressure when the pressure setting value is high, and thus the precision of pressure control may vary in this situation. For example, when a low viscosity liquid chemical is to be used, the pressure setting value will have to be lowered, and thus this type of problem can occur.

The present liquid chemical supply system may have a plurality of pressure detectors having different pressure detection ranges, and can switch the pressure detection range in response to the pressure setting value in order to change the resolution of the pressure detection, even if the pressure setting value of the operation gas pressure is to be appropriately changed in accordance with the type of liquid chemical to be used each time or other conditions. Because of this, the control of the discharge flow rate can always be performed accurately, regardless of the pressure setting value; pressure feedback control will always be correctly performed; and the discharge flow rate of the liquid chemical can be controlled with a high degree of precision.

In a liquid chemical supply system that is another aspect of the present teachings, the plurality of pressure detectors can include those having a wide pressure detection range and those having a narrow pressure detection range, and the detection signals of each pressure detector may be input into a control computation unit via an AD converter. In this construction, the detection signals (analog signals) of each pressure detector can be converted to digital signals by the AD converter, and the resolution (that is, the smallest unit of operation gas pressure that can be recognized by the control computation unit) of the digital signals will differ according to whether the pressure detection range of a pressure detector is wide or narrow. In this case, it is preferable that, when the pressure setting value is high, the detection results of the wide-range pressure detector be used to perform the pressure feedback control; and when the pressure setting value is low, the detection results of the narrow-range pressure detector be used. In this way, excellent pressure feedback control can be achieved, regardless of whether the pressure setting value is high or low.

A preferred construction may be one in which a wide-range pressure detector that is capable of pressure detection in the entire range in which the operation gas pressure can be adjusted, and a narrow-range pressure detector, separate from the wide-range pressure detector and having a narrower pressure detection range than the wide-range pressure detector, are provided in the operation gas supply device, and the plurality of pressure detectors can be comprised of the wide-range pressure detector and the narrow-range pressure detector.

Excellent pressure feedback control can be achieved with this construction as well. Note that pressure feedback control can be made even more accurate by means of a construction in which the narrow-range pressure detector is comprised of a plurality of pressure detectors having different pressure detection ranges.

The plurality of pressure detectors may be capable of pressure detection in pressure detection ranges in which the reference point of each is zero or near zero and the upper detection value of each differs. In other words, a construction having a wide-range pressure detector and narrow-range pressure detectors in which the reference point of each is zero or near zero is possible. In this case, the pressure feedback control can be performed based upon the detection results of the pressure detector having the lowest upper detection value amongst the pressure detectors in which the pressure setting value used falls within the pressure detection range.

This construction may also be designed such that, when an abnormality occurs with a pressure detector selected in accordance with the pressure setting value, the detection results of the other pressure detectors can be employed in order to perform the pressure feedback control.

When the plurality of pressure detectors performs pressure detection in pressure detection ranges in which the reference point of each is zero or near zero and the upper detection value of each differs, portions of the pressure detection ranges will overlap. In this situation, even if an abnormality occurs in any of the plurality of pressure detectors, the pressure detection system can change so as to employ other pressure detectors. Then, when an abnormality occurs with a pressure detector selected in accordance with the pressure setting value, the detection results of the other pressure detectors may be employed to perform the pressure feedback control. In this way, accurate handling can be provided when an abnormality occurs.

In addition, it is also possible for the entire pressure detection range of the present system to be divided into a plurality of segments and the plurality of pressure detectors to be constructed to respectively detect each range segment, and the detection results of each pressure detector can be selectively employed in accordance with the pressure setting value used.

In this case, by finely dividing the pressure detection range, and assigning individual pressure detectors to each range, the detection resolution can be improved regardless of whether the pressure detection value is high or low, thus improving control precision.

Furthermore, the pressure detectors can be connected via an on-off switching valve to an operation gas pathway that links the operation chamber and the operation gas supply device, and the on-off switching valve can be opened in accordance with the pressure setting value and the pressure detectors connected thereto can be placed in the pressure detection state.

By opening the on-off switching valve in accordance with the pressure setting value of the operation gas, the pressure in the operation gas pathway that links the operation chamber and the operation gas supply device is introduced into the pressure detectors, and pressure detection occurs. In this case, by opening the on-off switching valve, the correct pressure detector can be selectively employed each time.

In addition, in a liquid chemical supply system in which a plurality of the liquid chemical pumps are provided, it is preferable that the operation gas pathways connected to the operation chambers of each liquid chemical pump converge in a single part and the operation gas supply device be provided in that convergence part, and that the plurality of pressure detectors be provided in the same convergence part.

In a liquid chemical supply system in which a plurality of liquid chemical pumps are provided, by providing the operation gas supply device and the plurality of pressure detectors in the convergence part in which the operation gas pathways pass through the operation chambers of each liquid chemical pump, the operation gas supply device and the plurality of pressure detectors can share each pump. Thus, the construction can be simplified, and the present system can be reduced in size and cost.

DESCRIPTION OF THE PREFERRED EMBODIMENTS

An embodiment of the present invention will be described below in accordance with the drawings. An overview of the liquid chemical supply system according to the present embodiment will be described based upon FIG. 1.

A liquid chemical supply pump (hereinafter simply referred to as a pump) 11 is provided in the liquid chemical supply system of FIG. 1 in order to draw in and discharge liquid chemical. The pump 11 has a pump chamber 13 and an operation chamber 14 that are separated by a diaphragm 12 comprising a flexible membrane, and an intake pathway 15 (comprising an intake tube or the like) and a discharge pathway 16 (comprising a discharge tube or the like) are connected to the pump chamber 13. An intake valve 17 that is an intake side on-off valve is provided along the intake pathway 15, and the intake valve 17 opens and closes in response to the electrical conduction state of a solenoid valve 18. In addition, a discharge valve 19 that is a discharge side on-off valve and a suck-back valve 20 that is an on-off valve for suck back are provided along the discharge pathway 16, and the discharge valve 19 and the suck-back valve 20 open and close in response to the respective electrical conduction states of solenoid valves 21, 22. For example, the intake valve 17, the discharge valve 19, and the suck-back valve 20 are comprised of air-operated valves that are opened and closed by means of air pressure; the air pressure that operates the intake valve 17, the discharge valve 19, and the suck-back valve 20 is adjusted in response to the electrical conduction state of each solenoid valve 18, 21, 22, and each valve opens and closes as a result. Reference number 23 in FIG. 1 is an air supply source for generating pressurized air.

The intake pathway 15 can be a liquid chemical supply pathway for supplying liquid chemical to the pump chamber 13, and liquid chemical R stored inside a liquid chemical bottle (liquid chemical storage container) 25 is supplied to the pump chamber 13 via the intake pathway 15. In this way, the liquid chemical is charged into the pump chamber 13. Note that although not shown in the drawings, a pressurizing device is attached to the liquid chemical bottle 25, and the liquid chemical R is supplied to the pump chamber 13 in accordance with the pressurization of the space inside the bottle by this pressurization device.

In addition, the discharge pathway 16 is a liquid chemical discharge pathway for discharging liquid chemical charged into the pump chamber 13, and the liquid chemical discharged from the pump chamber 1-3 is supplied to a liquid chemical discharge nozzle 26 via the discharge pathway 16. Then, the liquid chemical is dripped onto a workpiece W from the tip of the liquid chemical discharge nozzle 26.

An air supply pathway 31 is connected to the operation chamber 14, and an electro-pneumatic regulator 32 and a pump solenoid valve 33 are provided along the air supply pathway 31. The electro-pneumatic regulator 32 adjusts the pressure of the operation air supplied to the operation chamber 14 from the air supply source 23, and the operation air pressure is feedback-controlled so as to match each target value. A pressure sensor 51 and a feedback control circuit are provided in the electro-pneumatic regulator 32. The pressure sensor 51 provided in the electro-pneumatic regulator 32 is configured as a sensor that is capable of detecting pressures in the entire pressure detection range that can be applied by the electro-pneumatic regulator 32, and thus will be referred to as a wide-range sensor.

Then, by switching the pump solenoid valve 33 so that the electro-pneumatic regulator 32 and the operation chamber 14 are linked to each other, the operation air whose pressure was adjusted by the electro-pneumatic regulator 32 is introduced into the operation chamber 14. In addition, by switching the pump solenoid valve 33 so that the air supply pathway 31 is connected to a vacuum source not shown in the drawings (or is open to the atmosphere), the operation air introduced into the operation chamber 14 is discharged. At this point, the supply or discharge of the operation air is performed by switching the pump solenoid valve 33, and the discharge/intake operation of the pump 11 is switched as a result.

In other words, when the liquid chemical is to be discharged, the intake valve 17 is closed, the discharge valve 19 is opened, and the operation chamber 14 and the electro-pneumatic regulator 32 are linked to each other by operation of the pump solenoid valve 33. When this occurs, the operation air is supplied inside the operation chamber 14, and the diaphragm 12 is displaced toward the pump chamber 13 in accordance with the rise in pressure inside the operation chamber 14. In this way, the capacity of the pump chamber 13 is reduced, and the liquid chemical charged into the pump chamber 13 is discharged to the downstream side via the discharge pathway 16. In contrast, when the liquid chemical is to be drawn in, the intake valve 17 is opened, the discharge valve 19 is closed, and the operation air inside the operation chamber 14 is vacuumed out therefrom, by operation of the pump solenoid valve 33, to thereby cause the diaphragm 12 that was moved toward the pump chamber 13 to be displaced toward the operation chamber 14. In this way, the capacity of the pump chamber 13 increases, and the liquid chemical is drawn into the pump chamber 13 from the upstream side via the intake pathway 15.

A controller 40 is an electronic control device that is primarily comprised of a microcomputer having a CPU, various memory devices, and the like, and controls the intake and discharge states of the liquid chemical by means of the pump 11. However, details thereof will be described below.

Various types of liquid chemical are used in the liquid chemical supply system described above, and the liquid viscosities thereof will differ depending upon the type of liquid chemical used. In such cases, if the discharge rates (the amount of discharge per unit time) are kept constant, the lower the viscosity of the liquid chemical, the lower the pressure level inside the operation chamber 14 adjusted by the electro-pneumatic regulator 32. In addition, with low viscosity liquid chemical, the discharge rate will heavily fluctuate with only a slight change in the pressure inside the operation chamber 14. As a result, when a low viscosity liquid chemical is to be used, it will be necessary to increase the precision with which the pressure of the operation air is controlled more than when a high viscosity liquid chemical is to be used. FIG. 3 is a graph showing the relationship between the discharge rate (the amount of discharge per unit time) and the operation air pressure, with respect to a low viscosity liquid chemical A and a high viscosity liquid chemical B. According to FIG. 3, it can be seen that the operation air pressure will be comparatively low with the low viscosity liquid chemical A, and the amount of change in the operation air pressure will be small with respect to the change in the discharge rate.

Accordingly, in the present embodiment, a plurality of pressure sensors having different pressure detection ranges is provided so as to allow the pressure detection region of the operation air pressure to be switched in response to the type of liquid chemical used (the fluid viscosity thereof). More specifically, in the system in FIG. 1, a plurality of atmosphere-opening pathways 61 is connected to the air supply pathway 31 between the electro-pneumatic regulator 32 and the pump solenoid valve 33, and an electromagnetic on-off valve 62 and a pressure sensor 63 are provided in each atmosphere-opening pathway 61. In the present embodiment, an n number of pressure sensors 63 is provided, and is appropriately expressed in the drawings and the following description as 63_1, **63_*n*, etc. The same also applies to the atmosphere-opening pathways 61 and the electromagnetic on-off valves 62**.

In this case, by selectively turning on the electromagnetic on-off valves 62 by means of the controller 40, the air pressure can be detected by some of the pressure sensors 63, and the detection signals thereof are input into the controller 40.

The pressure sensors 63 are capable of pressure detection in a pressure detection range that is narrower than that of the pressure sensor 51 provided in the electro-pneumatic regulator 32, e.g., when the pressure detection range of the pressure sensor 51 provided in the electro-pneumatic regulator 32 is between 0 and 200 kPa, the following pressure detection ranges will be set in each pressure sensor 63 (here, however, a situation in which three pressure sensors 63 are used is illustrated).

Pressure sensor 63_1: 0-20 kPa

Pressure sensor 63_2: 0-50 kPa

Pressure sensor 63_3: 0-100 kPa

In other words, each pressure sensor 51, and 63_1 to 63_3 is capable of pressure detection in pressure detection ranges in which the reference point is zero (near zero is also possible) and each upper detection value thereof is different.

Next, FIG. 2 will be employed to provide an overview of the control of the operation air pressure supplied by the electro-pneumatic regulator 32.

In FIG. 2, the controller 40 comprises an AD converter 41, a computation unit 42 and a DA converter 43, and pressure detection signals from the pressure sensor 51 for wide-range detection, and pressure detection signals from the pressure sensors 63 (63_3 to **63_*n*) for narrow-range detection, are respectively input into the computation unit 42 via the AD converter 41. At this point, the pressure detection signals (analog signals) of each pressure sensor are converted to digital values by the AD converter 41**, and digital values are provided in which the resolution thereof differs according to whether the pressure detection range of each pressure sensor is wide or narrow. In other words, with the pressure sensors in which the pressure detection range is wide, digital values in which the resolution is comparatively high will be provided, and with the pressure sensors in which the pressure detection range is narrow, digital values in which the resolution is comparatively low will be provided.

In addition, a pressure setting value set by an operator (user) is input into the computation unit 42. The pressure setting value is a value that is set in accordance with, for example, the type of liquid chemical to be used or the conditions under which the liquid chemical is to be supplied, and is set by inputting the same in an operation device provided in the present system.

Then, the computation unit 42 determines the pressure detection range currently needed based upon the pressure setting value, and selects the optimal pressure sensor for detecting the pressure in the pressure detection range. At this point, the computation unit 42 selects the pressure sensor having the lowest maximum detection value from amongst the pressure sensors in which each pressure setting value is included in the pressure detection range. For example, when the pressure detection range is set to one of the four ranges below by means of the pressure sensor 51 provided in the electro-pneumatic regulator 32 and the other three pressure sensors 63 (63_3 to 63_3), the following occurs.

(1) The pressure detection value of the pressure sensor 63_1 is employed if the pressure setting value is 0 to less than 20 kPa, (2) The pressure detection value of the pressure sensor 63_2 is employed if the pressure setting value is 20 to less than 50 kPa, (3) The pressure detection value of the pressure sensor 63_3 is employed if the pressure setting value is 50 to less than 100 kPa, and (4) The pressure detection value of the pressure sensor 51 is employed if the pressure setting value is 100 to less than 200 kPa.

However, this segmentation occurs in situations in which the effective detection range of the pressure sensors 51 and 63 are not taken into consideration, and in reality, the pressure sensor to be used is switched at a pressure value that is lower than the stipulated value in each pressure detection range (for example, in (1) above, the pressure detection value of the pressure sensor 63_3 is employed if the pressure setting value is 0 to 18 kPa).

Note that with the configuration shown in FIG. 2, all of the pressure detection signals of each sensor are sequentially input to the computation unit 42 via the AD converter 41; however, a configuration is also possible in which the pressure sensor to be used each time is alternatively selected in accordance with the pressure setting value, and only the pressure detection signal of the pressure sensor selected is input into the computation unit 42 via the AD converter 41. More specifically, a configuration may be adopted in which an input switching unit comprising a multiplexer ("multiplexor") or the like is provided prior to the AD converter 41, and the pressure detection signals are selectively input into the AD converter 41 by means of the input switching unit.

The computation unit 42 calculates the deviation between the pressure detection value of the pressure sensor 63 currently activated and the pressure setting value, and employs a PID control method or others to produce a control signal. Then, the control signal is output via the DA converter 43.

Meanwhile, an electromagnetic-type air supply valve 52 and the electromagnetic-type air discharge valve 53, which are connected in series, are provided on the electro-pneumatic regulator 32, pressurized air is supplied from the air supply source 23 to the air supply pathway 31 by opening the air supply valve 52, and the discharge of the operation air inside the air supply pathway 31 is performed by opening the air discharge valve 53. At this point, the operation air pressure is controlled by adjusting the aperture of the air supply valve 52 and the aperture of the air discharge valve 53, and is detected by the pressure sensor 51 or the pressure sensors 63 (63_1 to **63_*n***).

In addition, the electro-pneumatic regulator 32 comprises, as a feedback control circuit, a deviation calculation unit 55, a deviation amplification unit 56, a PWM control circuit 57, and a solenoid valve drive circuit 58. In this case, the deviation calculation unit 55 calculates the deviation between a control signal output from the controller 40 and a regulator internal F/B signal comprising the detection signal from the pressure sensor 51, and then the deviation amplification unit 56 amplifies the deviation. In addition, the PWM control circuit 57 produces a PWM output signal based upon the deviation after amplification, and the electromagnetic valve drive circuit 58 outputs the PWM output signal to control the air supply valve 52 and the air discharge valve 53.

Next, the operation of the present liquid chemical supply system will be described. FIG. 4 is a time chart showing the intake and discharge operations, etc. of the liquid chemical in the present system.

In FIG. 4, first, at timing t1, the intake valve 17 is opened in order to create a state in which the intake valve 17 is open and the discharge valve 19 is closed, and liquid chemical is drawn into the pump chamber 13 as a result (period from t1 to t2). Then, after the intake valve 17 is closed, the pump solenoid valve 33 is turned on (opened) at timing t3, and the operation air pressure inside the operation chamber 14 rises as a result. In the period in which the pump solenoid valve 33 is turned on (the period between t3 and t6), one of the pressure sensors is selected (any of the pressure sensors 51, and 63_1 to **63_*n*) in accordance with the previously set pressure setting value, and the operation air pressure is detected by the selected pressure sensor. Then, the operation of the electro-pneumatic regulator 32** is controlled based upon the pressure detection result, and the operation air pressure is controlled so as to achieve the target pressure setting value.

After that, at timing t4, the discharge valve 19 is opened in order to begin discharge of the liquid chemical, and the discharge of the liquid chemical is performed up to the timing t5 at which the discharge valve 19 is closed. In this way, a suitable quantity of liquid chemical is dripped onto the workpiece W from the liquid chemical discharge nozzle 26. Note that the suck-back valve 20 is placed in the push-out state during the discharge of the liquid chemical, and is placed in the draw-in state when discharge is completed. In this way, dribbling of the liquid chemical from the tip of the liquid chemical discharge nozzle 26 can be prevented.

After that, at timing t6, the pump solenoid valve 33 is turned off, and the series of intake and discharge operations is completed.

The liquid chemical supply system may also be configured such that a plurality of pumps 11 is provided, with different liquid chemicals supplied by each pump 11. FIG. 5 shows the overall configuration of a multi-pump system having a plurality of pumps 11. For convenience, the intake valve 17, the discharge valve 19, and the suck-back valve 20 in FIG. 5 have been simplified, together with the solenoid valves attached thereto; but as explained in FIG. 1, these valves open and close based upon the control signals from the controller 40.

In the system in FIG. 5, each air supply pathway 31 connected to each pump 11 is provided with a pump solenoid valve 33. In addition, the upstream portions of the air supply pathways 31 for each pump 11 converge into one, and the electro-pneumatic regulator 32, together with n number of atmosphere open pathways 61, electromagnetic on-off valves 62, and pressure sensors 63, are provided in that convergence part. The n number of pressure sensors 63, etc. have the same construction as in FIG. 1, and are shared among all the pumps 11.

With this configuration, the pump 11 to be used each time is switched in accordance with the liquid chemical to be supplied. At this point, the pump solenoid valve 33 of the pump 11 to be used is selectively turned on, and the intake valve 17, the discharge valve 19, etc are opened and closed. By providing a plurality of pumps 11, and assigning different liquid chemicals to each pump 11, it is not necessary to replace the liquid chemical in the pump and the liquid chemical pathway associated therewith when the liquid chemical in use is to be changed, thus improving the efficiency of changing the liquid chemical.

FIG. 6 is a time chart showing the liquid chemical intake, discharge operations, etc. in the multi-pump system. Note that in FIG. 6, the intake and discharge operations for two pumps 11 are shown, and for identification purposes, one of the pumps will be pump (A) and the letter (A) will be attached to the name of the component associated therewith, and the other pump will be pump (B) and the letter (B) will be attached to the name of the component associated therewith. The basic operation of each pump was explained in FIG. 4, and thus an explanation thereof will be omitted here.

Here, the liquid chemicals to be supplied by pump (A) and pump (B) differ, and thus the pressure setting value for pump (A) will be a high pressure value, and the pressure setting value for pump (B) will be a low pressure value. Said in terms of the liquid viscosity of the liquid chemical, the liquid chemical to be supplied by pump (A) is high viscosity, and the liquid chemical to be supplied by pump (B) is low viscosity.

In FIG. 6, first, the intake and discharge of liquid chemical by pump (A) is performed, and then the intake and discharge of liquid chemical by pump (B) is performed. In other words, the pump solenoid valve 33 for pump (A) is turned on first, and the operation air pressure inside the operation chamber 14 of pump (A) rises as a result. At this point, the pressure setting value is a high pressure value, and the operation air pressure is detected by the pressure sensor corresponding thereto (any of the pressure sensors 51, and 63_1 to 63_*n*). Then, the operation of the electro-pneumatic regulator 32 is managed based upon the pressure detection results, and the operation air pressure is controlled so as to become the target pressure setting value.

Next, the pump solenoid valve 33 for pump (B) is turned on (opened), and the operation air pressure inside the operation chamber 14 of pump (B) rises as a result. At this point, the pressure setting value will be a low pressure value, and the operation air pressure is detected by the corresponding pressure sensor (one of the pressure sensors 51, and 63_1 to 63_*n*). Then, the operation of the electro-pneumatic regulator 32 is managed based upon the pressure detection results, and the operation air pressure is controlled so as to become the target pressure setting value.

According to the present embodiment described above, the following superior effects can be obtained.

A plurality of pressure sensors 51, 63 (63_1 to 63_*n*) having different pressure detection ranges are provided as pressure detection means in order to detect the operation air pressure adjusted by the electro-pneumatic regulator 32, and pressure feedback control is performed by selectively employing one of the detection results of the plurality of pressure detectors in accordance with the pressure setting value used. In this way, pressure feedback control can always be correctly performed, and the discharge flow rate of the liquid chemical can be controlled with high precision, even when the pressure setting value of the operation air differs due to a change in the type of liquid chemical, etc. Because the discharge flow rate of the liquid chemical can be controlled with high precision, the thin films formed on a semiconductor wafer are uniform, thereby improving the quality of the product.

In this case in particular, because the system was designed to employ a wide-range pressure sensor having a wide pressure detection range when the pressure setting value is high, and employ narrow-range pressure sensors having narrow pressure detection ranges when the pressure setting value is low, ideal pressure feedback control can be achieved regardless of whether the pressure setting value is high or low.

Because the system was designed such that the electromagnetic on-off valve 62 opens in accordance with the pressure setting value used, enabling the pressure sensors 63 connected thereto to detect the pressure, the correct pressure sensor can be selectively employed each time.

In the multi-pump system having a plurality of pumps 11, because the air supply pathways 31 for each pump 11 converge at one point and the electro-pneumatic regulator 32 is provided at that convergence point, as is the plurality of sensors 63, the electro-pneumatic regulator 32 and the plurality of pressure sensors 63 can be shared among the pumps 11. Thus, the construction can be simplified and, as a result, the present system can be reduced in size and cost.

Note that the present invention is not limited to the disclosed details of the aforementioned embodiment, and may for example be implemented as follows.

In a construction in which a plurality of pressure sensors is employed to detect the operation air pressure as noted above, another sensor may be employed to perform pressure feedback control in the event that an abnormality occurs with the pressure sensor that was to have been used originally (i.e., the pressure sensor that was selected in accordance with the pressure setting value). In this case, the liquid chemical can be continuously supplied even when an abnormality occurs in a sensor, allowing accurate handling to be provided.

In the aforementioned embodiment, a plurality of sensors for detecting the operation air pressure were used, all of which have a pressure detection range in which the reference point is 0 (or near zero). However, in the current embodiment, this construction can be changed as follows. The entire pressure detection range in the present system may be divided into a plurality of segments, and a plurality of pressure sensors can be provided that can detect each of the pressure range segments. For example, when the entire pressure detection range is 0 to 200 kPa, the pressure detection range can be finely divided into ranges of 0 to 50 kPa, 50 to 100 kPa, 100 to 150 kPa, and 150 to 200 kPa. At this point, each finely divided pressure detection range may be of the same size or slightly different sizes. Furthermore, each pressure detection range may be set so as to partially overlap with each other. The present construction can also improve the resolution of pressure detection, thereby improving control precision.

Although a diaphragm was employed as the flexible membrane in the liquid chemical pump of the aforementioned embodiment, this may be changed. For example, a bellows may be employed to construct the liquid chemical pump.

Figure 1:
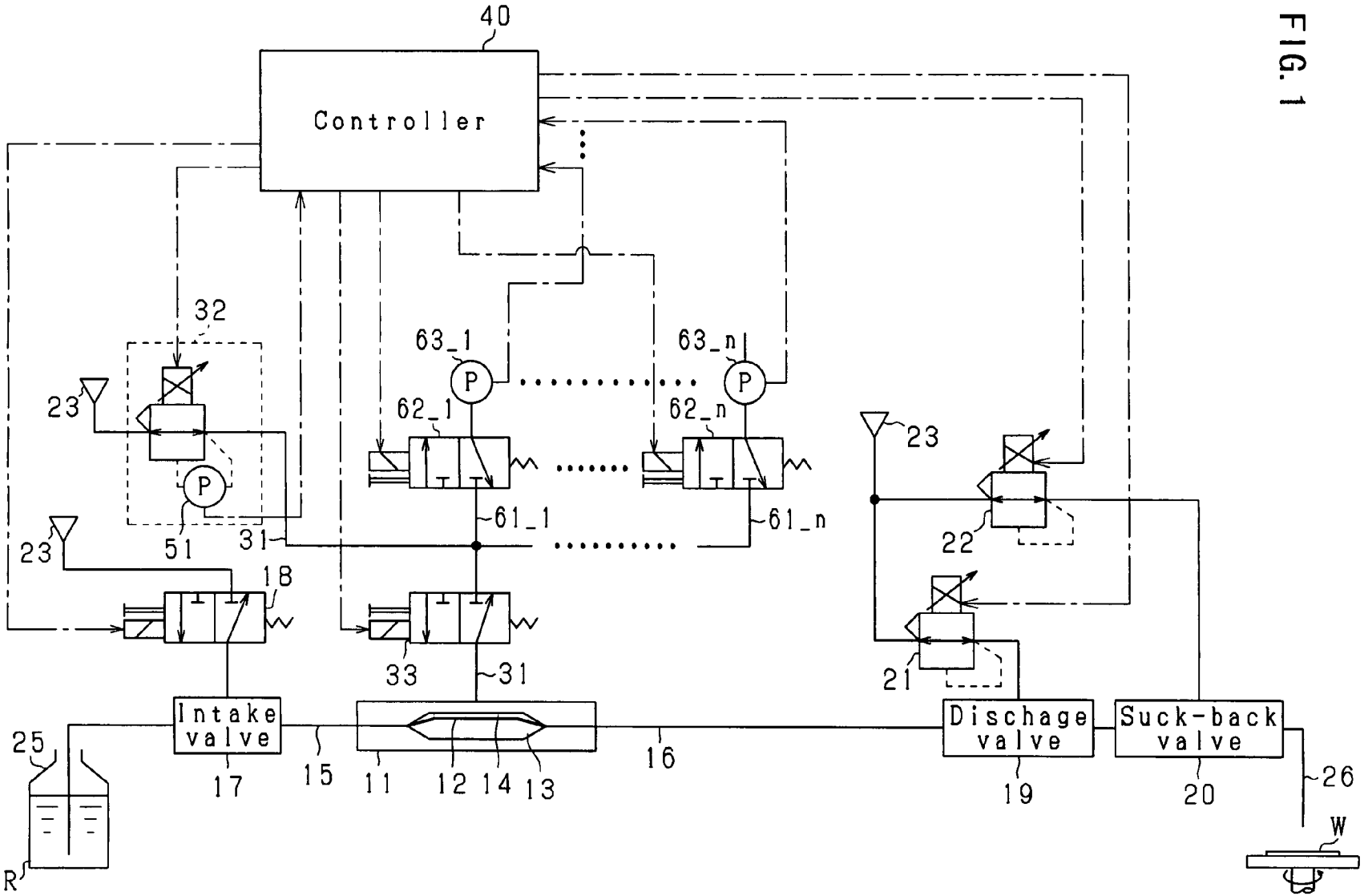
[FIG. 1] A configuration diagram showing an overview of a liquid chemical supply system in an embodiment of the present invention.
Figure 2:
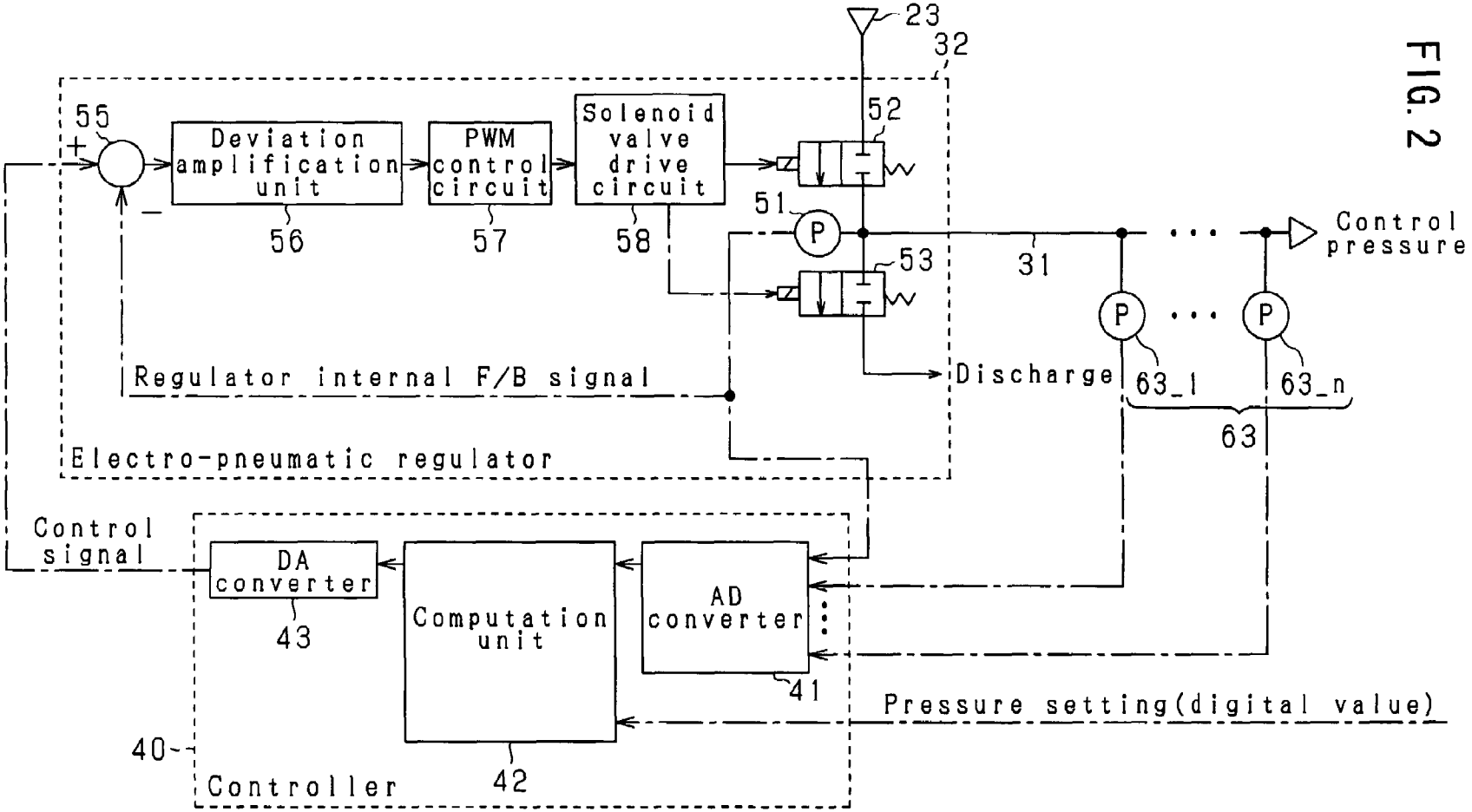
[FIG. 2] A diagram showing an overview of the control of the pressure of operation air supplied by an electro-pneumatic regulator.
Figure 3:
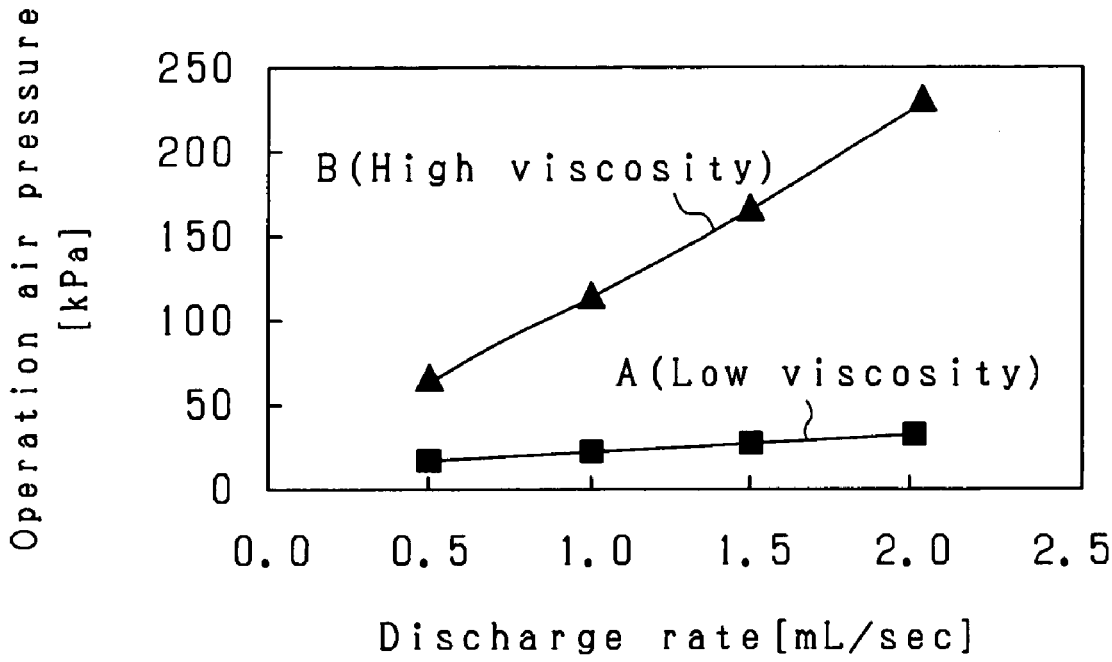
[FIG. 3] A graph showing the relationship between the discharge rate and the operation air pressure.
Figure 4:
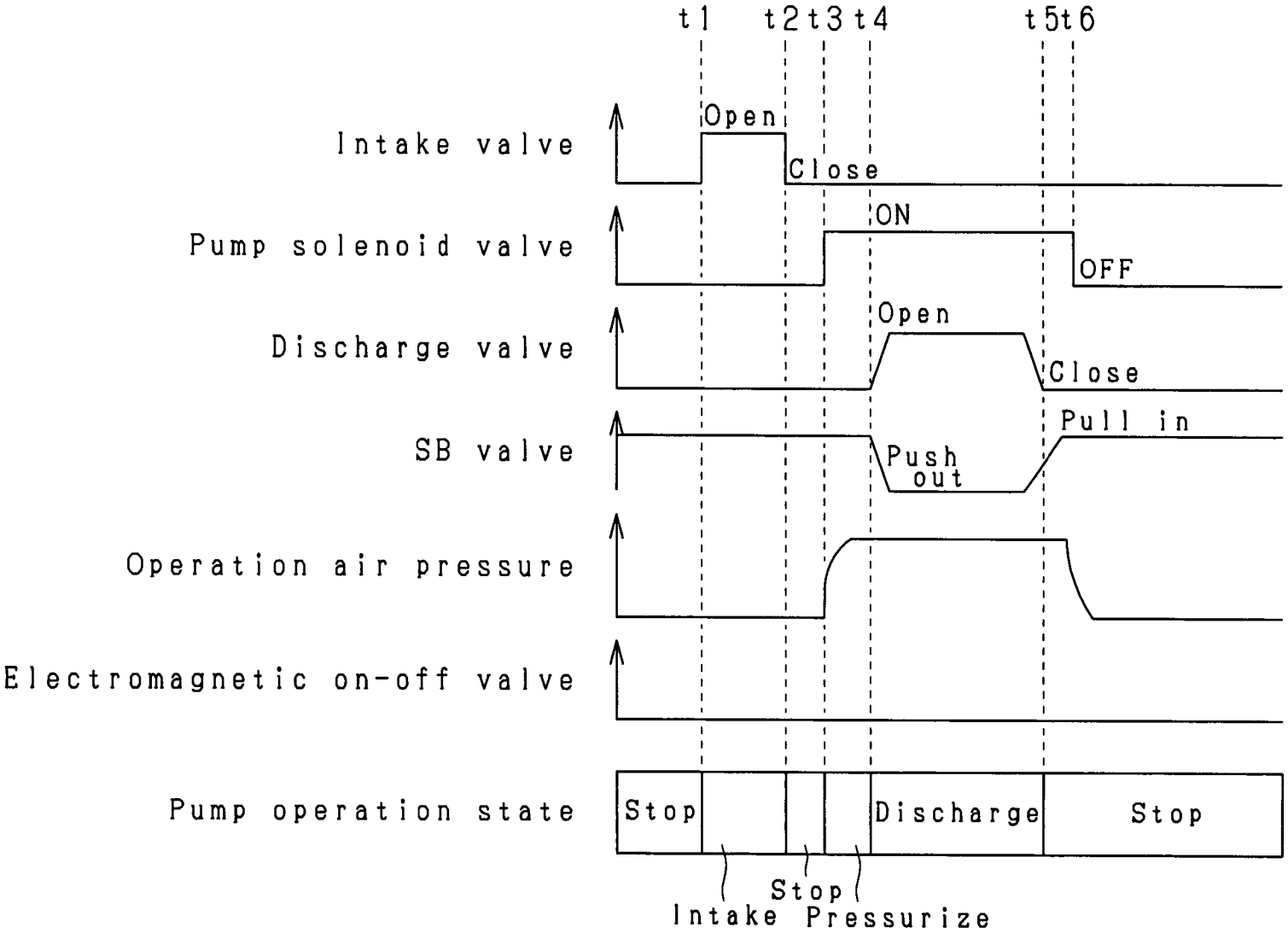
[FIG. 4] A time chart showing the liquid chemical intake and discharge operation and others in the present system.
Figure 5:
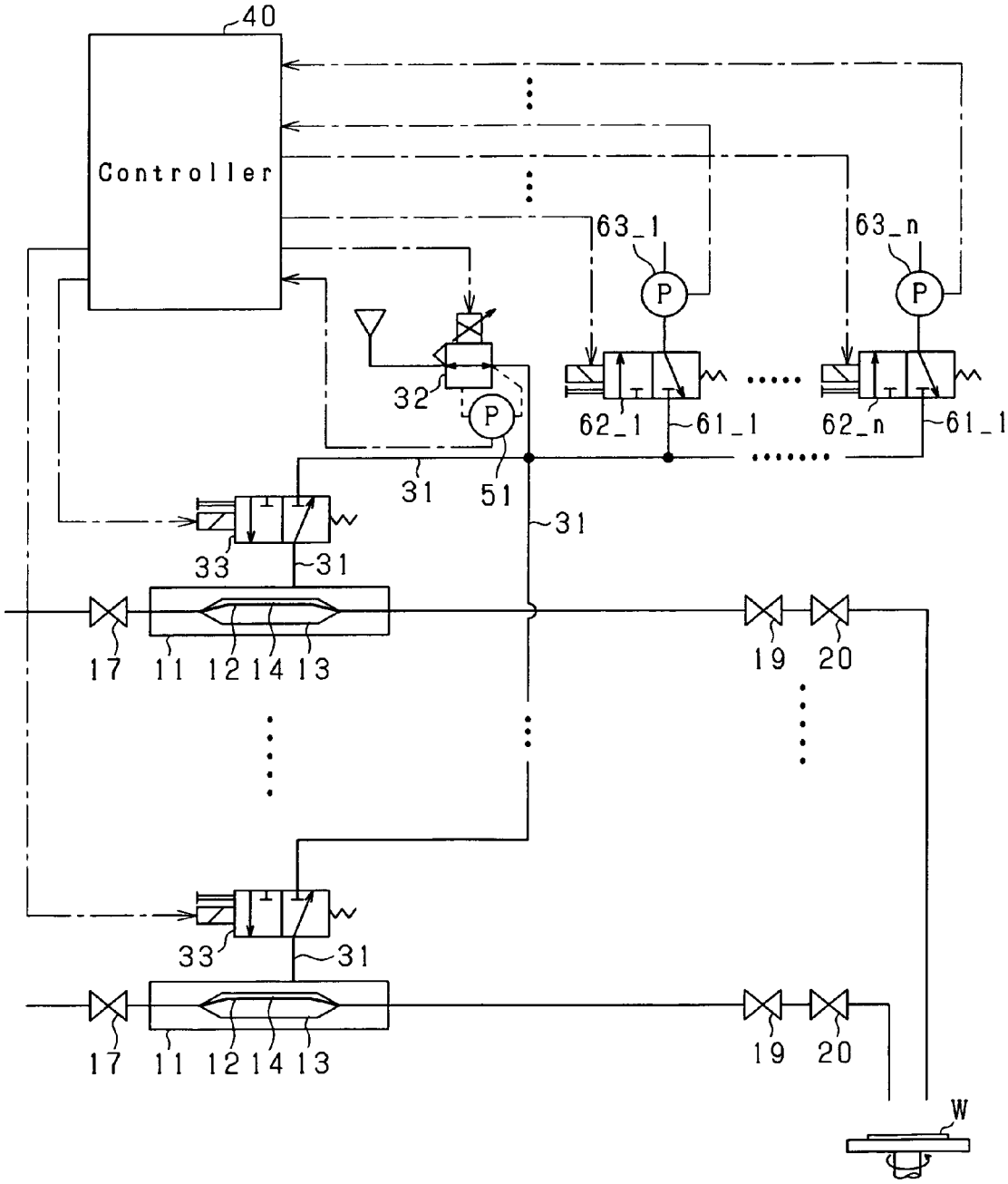
[FIG. 5] A diagram showing an overview of a multi-pump system having a plurality of pumps.
Figure 6:
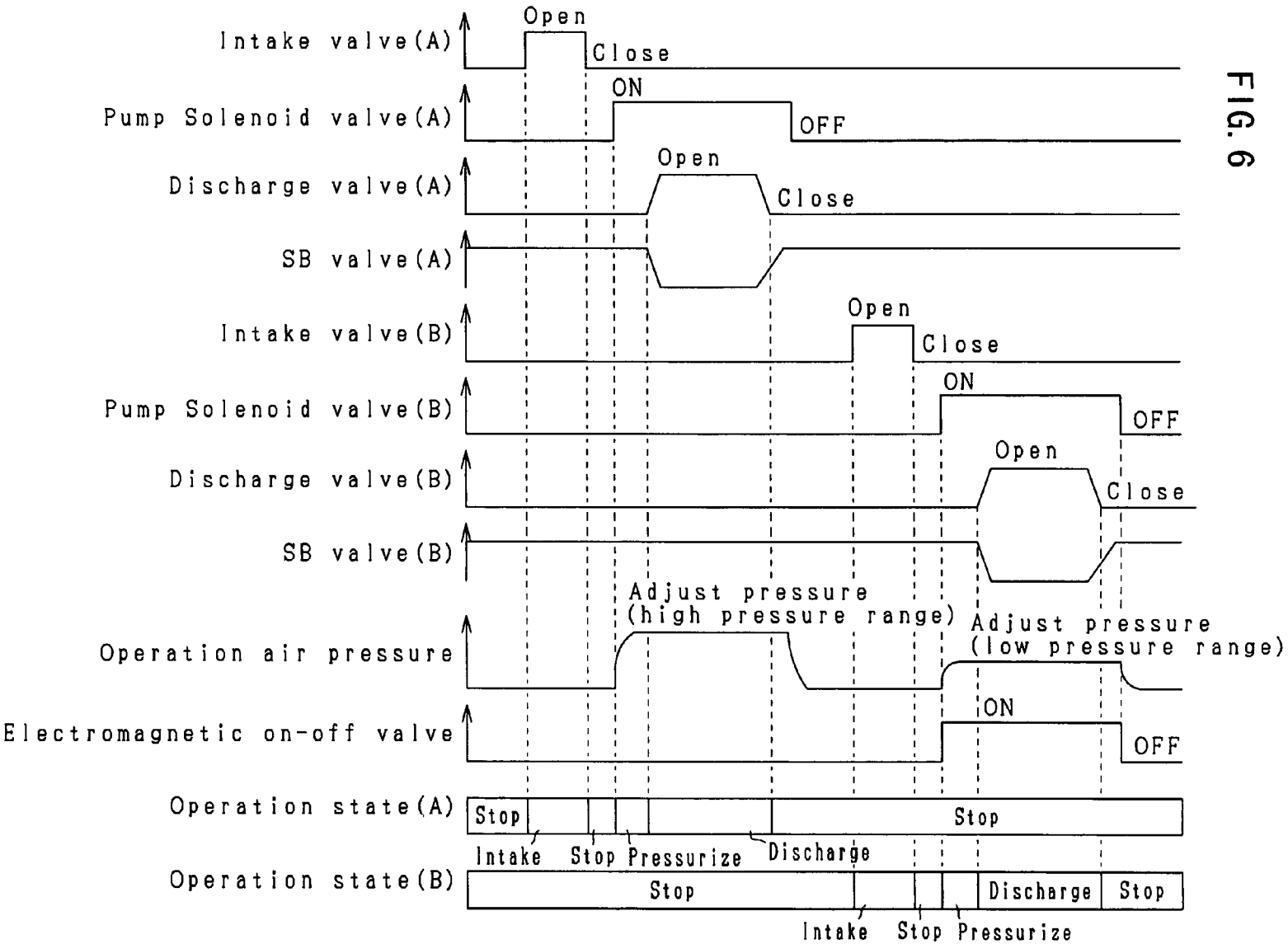
[FIG. 6] A time chart showing the liquid chemical intake and discharge operation and others in the multi-pump system.

The invention claimed is:

1. A liquid chemical supply system, comprising:

a liquid chemical pump comprising:

a pump chamber;

an operation chamber; and a flexible membrane that separates the pump chamber and operation chamber, the liquid chemical pump performing intake and discharge of a liquid chemical by changing the volume of the pump chamber in accordance with a change in pressure inside the operation chamber;

the liquid chemical supply system further comprising:

an operation gas supply device; and a plurality of pressure detectors having different pressure detection ranges that detect a pressure of an operation gas supplied by the operation gas supply device; and a controller that performs pressure feedback control by selectively employing a detection result of one of the plurality of pressure detectors in accordance with a pressure setting value of the operation gas, the pressure setting value being newly set before each operation of the liquid chemical supply system;

a plurality of on-off switching valves; and an operation gas pathway that links the operation chamber and the operation gas supply device, wherein each of the pressure detectors are connected via a corresponding one of the on-off switching valves to the operation gas pathway, each of the on-off switching valves is capable of being opened in accordance with the pressure setting value, and the pressure detectors are placed in a pressure detection state.

2. The liquid chemical supply system according to claim 1, wherein the plurality of pressure detectors are capable of pressure detection in pressure detection ranges in which the reference point of each pressure detector range is zero or near zero and the upper detection value of each pressure detection range differs, and the controller performs the pressure feedback control based on the detection result of the pressure detector having a pressure detection range with the lowest upper detection value among the pressure detectors having pressure detection ranges in which the pressure setting value falls.

3. The liquid chemical supply system according to claim 2, wherein on the condition that an abnormality occurs with a pressure detector selected in accordance with the pressure setting value, the controller employs the detection results of other pressure detectors in order to perform the pressure feedback control.

4. The liquid chemical supply system according to claim 1, wherein an entire pressure detection range of the liquid chemical supply system is divided into a plurality of segments, each of the plurality of pressure detectors is capable of detecting pressure within a corresponding segment of the plurality of segments, and the controller selectively employs the detection result of a pressure detector in accordance with the pressure setting value used.

5. The liquid chemical supply system according to claim 1, further comprising:

a plurality of the liquid chemical pumps; and a plurality of operation gas pathways, wherein each of the operation gas pathways is connected to the operation chamber of a corresponding one of the liquid chemical pumps, the operation gas pathways converging at a convergence part, and the operation gas supply device and the plurality of pressure detectors are provided at the convergence part.

6. The liquid chemical supply system according to claim 1, wherein the plurality of pressure detectors includes at least one wide-range pressure detector and at least one narrow-range pressure detector, the wide-range pressure detector is capable of pressure detection in the entire range in which the operation gas pressure can be adjusted, the narrow-range pressure detector has a narrower pressure detection range than the pressure detection range of the wide-range pressure detector, and the wide-range pressure detector and the narrow-range pressure detector are provided in the operation gas supply device.

7. A liquid chemical supply system, comprising:

a liquid chemical pump comprising:

a pump chamber;

an operation chamber; and a flexible membrane that separates the pump chamber and the operation chamber, the liquid chemical pump performing intake and discharge of a liquid chemical by changing the volume of the pump chamber in accordance with a change in pressure inside the operation chamber;

the liquid chemical supply system further comprising:

an operation gas supply device;

a plurality of pressure detectors having different pressure detection ranges that detect the pressure of an operation gas supplied by the operation gas supply device, the plurality of pressure detectors including at least one wide-range pressure detector and at least one of a narrow-range pressure detector; and a controller comprising:

a control computation unit; and an AD converter;

wherein the controller performs pressure feedback control by selectively employing a detection result of one of the plurality of pressure detectors in accordance with a pressure setting value of the operation gas, the pressure setting value being newly set before each operation of the liquid chemical supply system, wherein each pressure detector generates detection signals that are input into the control computation unit via the AD converter and the detection results of the wide-range pressure detectors are used to perform pressure feedback control when the pressure setting value is high, and the detection results of the narrow-range pressure detectors are used when the pressure setting value is low, the liquid chemical supply system further comprising:

a plurality of on-off switching valves; and an operation gas pathway that links the operation chamber and the operation gas supply device, wherein each of the pressure detectors are connected via a corresponding one of the on-off switching valves to the operation gas pathway, each of the on-off switching valves is capable of being opened in accordance with the pressure setting value, and the pressure detectors are placed in a pressure detection state.

8. The liquid chemical supply system according to claim 7, wherein the plurality of pressure detectors are capable of pressure detection in pressure detection ranges in which the reference point of each pressure detector range is zero or near zero and the upper detection value of each pressure detector range differs, and the controller performs the pressure feedback control based upon the detection result of the pressure detector having a pressure detection range with the lowest upper detection value among the pressure detectors having pressure detection ranges in which the pressure setting value falls.

9. The liquid chemical supply system according to claim 8, wherein on the condition that an abnormality occurs with a pressure detector selected in accordance with the pressure setting value, the controller employs the detection results of other pressure detectors in order to perform the pressure feedback control.

10. The liquid chemical supply system according to claim 7, wherein an entire pressure detection range of the liquid chemical supply system is divided into a plurality of segments, each of the plurality of pressure detectors is capable of detecting pressure within a corresponding segment of the plurality of segments, and the controller selectively employs the detection result of a pressure detector in accordance with the pressure setting value used.

11. The liquid chemical supply system according to claim 7, further comprising:

a plurality of the liquid chemical pumps; and a plurality of operation gas pathways, wherein each of the operation gas pathways is connected to the operation chamber of a corresponding one of the liquid chemical pumps, the operation gas pathways converging at a convergence part, and the operation gas supply device and the plurality of pressure detectors are provided at the convergence part.

12. The liquid chemical supply system according to claim 7, wherein the plurality of pressure detectors includes at least one wide-range pressure detector and at least one narrow-range pressure detector, the wide-range pressure detector is capable of pressure detection in the entire range in which the operation gas pressure can be adjusted;

the narrow-range pressure detector has a narrower pressure detection range than the pressure detection range of the wide-range pressure detector, and the wide-range pressure detector and the narrow-range pressure detector are provided in the operation gas supply device.

13. A liquid chemical supply system, comprising:

a plurality of liquid chemical pumps, each pump comprising:

a pump chamber;

an operation chamber; and a flexible membrane that separates the pump chamber and operation chamber, the liquid chemical pump performing intake and discharge of a liquid chemical by changing the volume of the pump chamber in accordance with a change in pressure inside the operation chamber;

the liquid chemical supply system further comprising:

an operation gas supply device; and a plurality of pressure detectors having different pressure detection ranges that detect a pressure of an operation gas supplied by the operation gas supply device; and a controller that performs pressure feedback control by selectively employing a detection result of one of the plurality of pressure detectors in accordance with a pressure setting value of the operation gas, the pressure setting value being newly set before each operation of the liquid chemical supply system, a plurality of operation gas pathways, wherein each of the operation gas pathways is connected to the operation chamber of a corresponding one of the liquid chemical pumps, the operation gas pathways converging at a convergence part, and the operation gas supply device and the plurality of pressure detectors are provided at the convergence part.

14. The liquid chemical supply system according to claim 13, wherein the plurality of pressure detectors includes at least one wide-range pressure detector and at least one narrow-range pressure detector, the wide-range pressure detector is capable of pressure detection in the entire range in which the operation gas pressure can be adjusted, the narrow-range pressure detector has a narrower pressure detection range than the pressure detection range of the wide-range pressure detector, and the wide-range pressure detector and the narrow-range pressure detector are provided in the operation gas supply device.

15. The liquid chemical supply system according to claim 13, wherein the plurality of pressure detectors are capable of pressure detection in pressure detection ranges in which the reference point of each pressure detector is zero or near zero and the upper detection value of each pressure detection range differs, and the controller performs the pressure feedback control based on the detection result of the pressure detector having a pressure detection range with the lowest upper detection value among the pressure detectors having pressure detection ranges in which the pressure setting value falls.

16. The liquid chemical supply system according to claim 13, wherein when on the condition that an abnormality occurs with a pressure detector selected in accordance with the pressure setting value, the controller employs the detection results of other pressure detectors in order to perform the pressure feedback control.

17. The liquid chemical supply system according to claim 13, wherein an entire pressure detection range of the liquid chemical supply system is divided into a plurality of segments, each of the plurality of pressure detectors is capable of detecting pressure within a corresponding segment of the plurality of segments, and the controller selectively employs the detection result of a pressure detector in accordance with the pressure setting value.

* * * * *